United States Patent [19]

Buteaux

[11] Patent Number: 4,577,262

[45] Date of Patent: Mar. 18, 1986

[54] LIFE PRESERVER STORAGE CONTAINER

[76] Inventor: Leonard J. Buteaux, 114 Dock Rd., New Iberia, La. 70560

[21] Appl. No.: 629,920

[22] Filed: Jul. 11, 1984

[51] Int. Cl.[4] ..... F21V 33/00; F21V 23/04

[52] U.S. Cl. ..... 362/155; 200/60; 206/803; 362/154; 362/208; 362/295; 441/136

[58] Field of Search ..... 362/154, 155, 208, 295; 220/22.4, 203, 315, 334, 335, 336; 200/60; 441/136; 206/282, 292, 803

[56] References Cited

U.S. PATENT DOCUMENTS

| | | | |
|---|---|---|---|
| 1,375,341 | 4/1921 | Wizner | 362/155 |
| 2,052,382 | 8/1936 | Coaltrin | 362/154 |
| 2,179,409 | 11/1939 | Hulsart | 362/154 |
| 2,644,882 | 7/1953 | Voda | 362/155 |
| 3,937,320 | 2/1976 | Chao et al. | 362/155 |
| 3,938,132 | 2/1976 | Cunningham | 362/154 |
| 4,168,411 | 9/1979 | Peck | 362/155 |
| 4,186,426 | 1/1980 | Gingras, Sr. et al. | 362/154 |

*Primary Examiner*—Stephen J. Lechert, Jr.
*Assistant Examiner*—Howard J. Locker
*Attorney, Agent, or Firm*—Pravel, Gambrell Hewitt & Kimball

[57] ABSTRACT

A container for storage on an offshore work site. A lightweight metal container is provided with a latching mechanism which is operable by hand or foot pressure for allowing opening of the container. The container has attached thereto a spring loaded assembly for causing automatic opening of the top upon release of the latching mechanism from the top. A power source, switch and lamp are attached to the container for automatic illumination of the contents therein upon opening of the top.

8 Claims, 2 Drawing Figures

LIFE PRESERVER STORAGE CONTAINER

BACKGROUND OF THE INVENTION

1. Field of the Invention

The present invention relates to storage containers, and more particularly is related to storage containers for life preservers on offshore rigs.

2. General Background

In the oil and gas industry, operations such as drilling and production are commonly conducted offshore in open waters. Conducting these operations offshore necessitates that a supply of life preservers be kept at accessible locations on the site in the event that an emergency should arise. Emergencies such as a worker falling in the water, blowouts, storms or other such emergencies require that a number of life preservers be quickly and easily accessible to ensure safety of workers on the site. Quick and easy access to a number of life preservers in a variety of locations is also necessary to meet with safety standards required for offshore work sites. Also, storage of life preservers is necessary to protect the life preservers from the elements and prevent deterioration, thereby ensuring that an effective and efficient life saving system is provided on the site.

A problem encountered with the storage of a number of life preservers on an offshore drilling or production site is that of the life expectancy of the containers used in storing the life preservers. In the present state of the art, fiberglass storage containers are commonly used to store life preservers on offshore sites. It is generally realized in this environment that the presently used fiberglass storage containers have a life expectancy of approximately one year. This presents a problem in both maintenance and cost as the maintenance must be increased in maintaining the containers in a safe and usable condition and also to adequately protect the life preservers. Another factor or problem created is that of costs. Frequent replacement adds to the general operating costs in terms of both equipment and man hours spent in replacing and maintaining a fiberglass container.

Another problem encountered with the fiberglass containers is that of warping and sticking. The fiberglass containers generally have a top which must be manually opened by hand by a worker desiring to extract a life preserver from the container. Two problems are encountered here, first, the fiberglass containers have a tendency to warp and cause the tops to be difficult to open as they warp and stick to the sides of the container. Also, in the event of an emergency such as a blowout, workers who may have injured or burned hands are presented with extreme difficulty in opening the box, whether the top is warped or not, due to the weight of the top and possibly the extra difficulty encountered if the top is warped due to injured hands. This is an extremely dangerous condition as abandoning of the work site into the water may be necessary.

U.S. Pat. No. 391,376, entitled "Life Preserver Rack And Alarm" issued to McFarlane and discloses an overhead life preserver rack. The rack is comprised of longitudinal slats which are held together by cross strips. One side of the rack is hingedly attached to ceiling joists by eyebolts to allow hinged movement of one side of the rack. A bar is provided which is parallel to the longitudinal slats and has protrusions extending therefrom which engage with eyebolts on the rack to maintain the rack in an overhead position. A means for slidably moving the bar is provided so that the protrusions disengage from the eyebolts, allowing the rack to dispense life preservers stored thereon.

U.S. Pat. No. 791,765, entitled "Holder For Life Preservers" issued to French and discloses an overhead rack for life preservers to be used on ships. An overhead door is hinged and provided with a release means which may be utilized to release one or more racks at the same time. A metal strap is extended upwardly and curved to support the life preservers during reloading of the container and also to support the life preservers upon opening of the rack.

U.S. Pat. No. 277,269, entitled "Life Preserver Holder" issued to Gray and discloses an apparatus for holding life preservers on a vessel. Frames or gates are hingedly attached to the ceiling beams of a vessel and provided with a sliding bolt for maintaining the gates in position. Bolts removably attached to the gates have a spring loaded sliding bar engaged therewith to cause release of the gates and dispensing of life preservers. The sliding bar is provided with cam portions to cause the bolts to release a plurality of gates and dispense a large number of life preservers at one time.

U.S. Pat. No. 1,375,341, entitled "Automatic Lighting Device For Talking Machines" issued to Wizner and discloses a support arm pivotally mounted on a screw bolt to the side of the cabinet cover of a phonograph. The support arm has a shoulder pin at its lower end upon which is mounted a cylindrical contact. A plate secured to the upper edge of one side of the cabinet is provided with a block having an arcuate recess upon which are positioned a pair of electrical contacts. Upon placing the cylindrical contact in the arcuate recess to support the cabinet cover in its open position, a circuit is completed with the pair of contacts to illuminate a lamp powered by batteries connected in circuit with the lamp and contacts.

U.S. Pat. No. 1,189,592, entitled "Illuminating Device" issued to Lutz and discloses a box or cabinet which is provided with a pivoted cover. A battery container, lamp and contact device are attached to the outer end of the cover. The contact device is comprised of a pivotal bearing, a pendant arm pivoted thereon and provided with an enlarged weighted portion which extends from one side of its diameter and a contact finger which extends from the other side. A contact plate is placed so as to be in the path of the contact finger when the cover is opened thus completing the circuit and illuminating the lamp.

U.S. Pat. No. 2,644,882 entitled "Illuminated Handle For Refrigerated Cabinet Doors" issued to Voda and discloses a handle having a rubber encased electrical lamp socket mounted therein and secured by an annular rib or groove. An electric cord supplies current to the socket and an electric lamp secured in the socket. An electric switch connected to the socket is provided with a spring biased plunger for opening and closing the circuit upon movement of the door.

U.S. Pat. Nos. 3,937,320; 2,801,330; 3,938,132; and 712,112 all disclose containers which are illuminated when the lid is lifted and are powered by batteries.

None of the above patents disclose containers which may be used for storage and dispensing of life preservers at an offshore site. A container which is weather resistant, has a long life, protects life preservers from the elements encountered offshore and also provides easy dispensing of life preservers during an emergency is needed at offshore work sites.

SUMMARY OF THE INVENTION

The present invention solves the aforementioned problems in a straightforward manner. What is provided is a lightweight metal container which is easy opening, resists warping and has a life expectancy equal to that of the offshore work site. The container is substantially rectangular and constructed of a lightweight metal. A bottom portion has four sides rigidly attached thereto and extending upward therefrom. The container has a top hingedly attached to one of the sides to serve as a cover for closing the container and protecting the life preservers stored therein from the elements. A lifting assembly is rigidly attached to the outside rear of the side portion to which the cover is hingedly attached and a lifting arm extending from the lift assembly is rigidly attached substantially at the rear of the top. The lifting assembly and lifting arm are spring loaded to cause the top to automatically open by spring pressure when a latch on the forward portion is released. The top is also provided with a downwardly extending flange around each side and the front portion to further serve as a seal around the outer edges of the top and the sides of the container for better protecting the life preservers therein. A latching mechanism for maintaining the top in its closed position and releasing the top for automatic opening is provided adjacent the forward end of the top and on the forward side portion of the container. The latch is spring loaded and may be caused to release the top for opening by either foot pressure on a foot pedal provided at the lower portion of the front side of the container or by a handle for hand operation and release of the top. Upon automatic opening of the top, a light positioned at substantially the center of the top and facing toward the interior of the container is caused to be illuminated by an automatic switch activated by the opening of the top. Power for illumination of the light is provided by a battery stored in a battery box mounted on the exterior of one side portion of the container.

In view of the above, it is an object of the present invention to provide a storage container which is easily opened.

It is another object of the invention to provide a storage container with a long life expectancy and which resists warping.

It is a further object of the invention to provide a storage container which illuminates the contents therein upon opening of the container.

In view of the above objects, it is a feature of the invention to provide a spring loaded top which automatically opens upon release of a latching mechanism.

It is another feature of the invention to provide a latching mechanism which is operable by hand or foot pressure.

It is yet another feature of the invention to provide a storage container which is constructed of lightweight metal.

It is further feature of the invention to provide a storage container having a light which is automatically activated upon opening of the top.

BRIEF DESCRIPTION OF THE DRAWING

For a further understanding of the nature and objects of the present invention, reference should be had to the following detailed description, taken in conjunction with the accompanying drawings, in which like parts are given like reference numerals and, wherein.

DETAILED DESCRIPTION OF THE INVENTION

Figure 1:
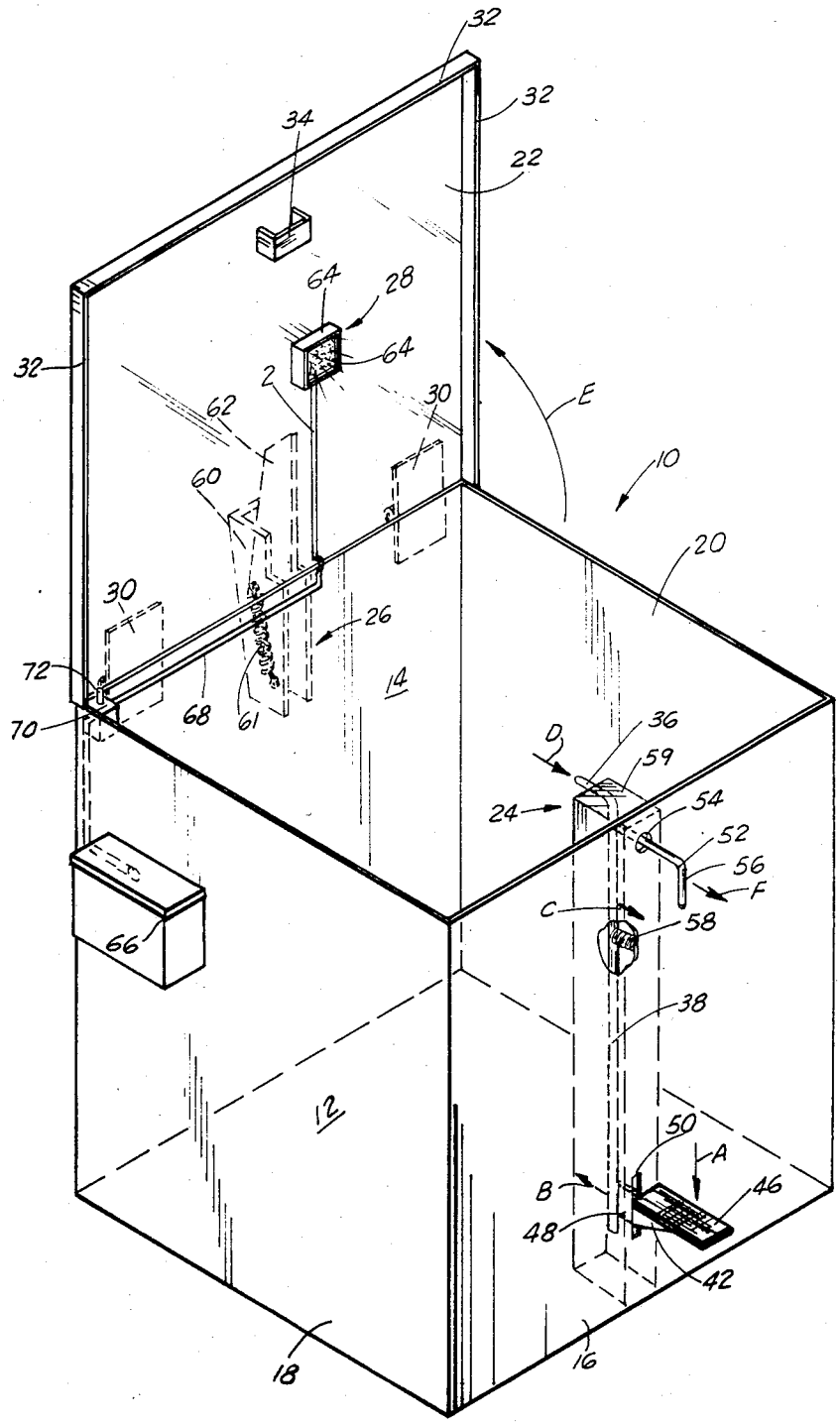
FIG. 1 is an overall perspective view of the apparatus.

Referring now to the drawings, it can be seen that the apparatus is generally referred to by the numeral 10. Apparatus 10 is generally comprised of a bottom 12 having four sides 14, 16, 18 and 20 integrally attached thereto and a top 22 pivotally attached to one of the side portions to define a storage container. Apparatus 10 is also provided with means 24 for latching and/or unlatching top 22, means 26 for causing top 22 to open upon release of latch means 24 from top 22 and means 28 for illumination of the interior of apparatus 10 when top 22 is in its open position.

Bottom 12 is rigidly attached to rear wall 14 at the rear end of bottom 12 so as to form a substantially 90° angle between bottom 12 and rear wall 14. Front wall 16 likewise is rigidly attached to the front portion of bottom 12 to form a substantially 90° angle between bottom 12 and front wall 16. Side walls 18 and 20 are also rigidly attached to the left side and right side of bottom 12. Rear wall 14, front wall 16 and side walls 18 and 20 are all sized along their width so as to be substantially equal to the side portions of bottom 12 to which they are attached so that all sides abut each other when attached to bottom 12 at their ends to define a space therebetween for storage of items. Rear wall 14 and front wall 16 are rigidly attached to side walls 18 and 20 at their respective abutment points to form a rigid container. Rear wall 14, front wall 16 and side walls 18 and 20 are also constructed so as to be substantially the same height to form a continuous and unbroken edge around the upper portion of apparatus 10 for the placement of top 22 thereupon.

It can be seen that top 22 is pivotally attached at substantially the upper portion of rear wall 14 by means of hinges 30. Hinges 30 are rigidly attached adjacent the upper portion of rear wall 14 and the rear portion of top 22 by welding or the like to allow opening of container 10 by pivotal movement of top 22 toward the rear of apparatus 10. This prevents the inconvenience of having to physically remove top 22 from apparatus 10 and store it in an adjacent location when access to the contents of apparatus 10 is necessary. The illustration of hinges 30 in the phantom view indicate that hinges 30 are positioned on the outside of apparatus 10 but it should be noted that hinges 30 may also be positioned on the inside of apparatus 10 if necessary. Top 22 is provided with downwardly extending flange 32 around at least the front and side portions of its outer edge to act as a sealing means for protection of the items stored within apparatus 10 from the ambient weather conditions. Flange 32 also serves to provide rigidity to apparatus 10 when top 22 is in its closed position by prevention of any lateral movement of top 22 and placement of stress upon hinges 30.

Means 24 for latching top 22 in its closed position and/or unlatching top 22 to allow opening of top 22 and access to the contents of apparatus 10 are provided on front wall 16 and top 22. Closing latch 34 is rigidly attached to the bottom portion of top 22 and positioned substantially near the front center thereof for receiving release pin 36 to maintain top 22 in the closed position. Closing latch 34 generally comprises a substantially U-shaped rigid material such as metal rigidly attached at its upper portions to the bottom of top 22 and defining a space between top 22 and the lower portion of closing latch 34 for receiving release pin 36.

Release pin 36 is substantially parallel to bottom portion 23 and extends horizontally toward the rear of apparatus 10 to be received by closing latch 34 when release pin 36 is in its rearward most position. Release pin 36 is supported by rigid attachment to vertical rod or bar 38. Release pin 36 is illustrated as being integral with rod 38 but also may be a separate member rigidly attached to rod 38. The lower portion of rod 38 is slidably engaged with rearward portion 48 of foot pedal 42. Foot pedal 42 is pivotally attached substantially near its center to front wall 16 so as to cause pivotal movement of foot pedal 42 when pressure is applied to forward portion 46 of foot pedal 42. It can be seen that downward pressure as indicated by ARROW A on the horizontal portion of the forward portion 46 will cause upward and rearward movement of the rearward portion 48 of foot pedal 42. This in turn will cause deflection of the lower portion of rod 38 toward the rear of apparatus 10 as indicated in phantom view in FIG. 2 by ARROW B. The interaction of the biasing and pivotal connection of rod 38 with spring 58 results in deflection of the upper portion of rod 38 toward the front portion of apparatus 10 as indicated by ARROW C in FIG. 1. The rigid connection of release pin 36 to rod 38 results in deflection of release pin 36 toward the forward portion of apparatus 10, thus disengaging release pin 36 from closing latch 34 and allowing the opening of top 22 as indicated by ARROWS D and E. It can be seen in the drawings that foot pedal 42 extends through slot 50 provided in front wall 16 of apparatus 10 for engagement with rod 38.

A second means for disengagement of release pin 36 from closing latch 34 by other than use of foot pressure is provided near the upper end of front wall 16 of apparatus 10. Handle 52 is rigidly attached near the upper end of rod 38 and extends through aperture 54 provided in front wall 16. Handle 52 has vertically extending portion 56 to provide the user with a means of effectively causing handle 52 to be moved in the direction indicated by ARROW F to cause disengagement of release pin 36 from closing latch 34 as indicated by ARROW D for allowing top 22 to be opened.

A means for maintaining release pin 36 in engagement with closing latch 34 to prevent accidental release and opening of top 22 is provided by spring 58. Spring 58 is positioned intermediate rod 38 and the interior of front wall 16 to normally bias rod 38 and release pin 36 toward the rear of apparatus 10. This maintains release pin 36 in engagement with closing latch 34 when top 22 is in it closed position, thereby preventing accidental release of the latching mechanism and opening of top 22.

Housing 59 is provided interior of apparatus 10 and is attached to front wall 16. Housing 59 encloses the major portion of latch means 24 as illustrated and serves to prevent the life preservers or other materials stored within apparatus 10 from becoming tangled with latch means 24 and causing fouling of its release and latch capabilities.

Figure 2:
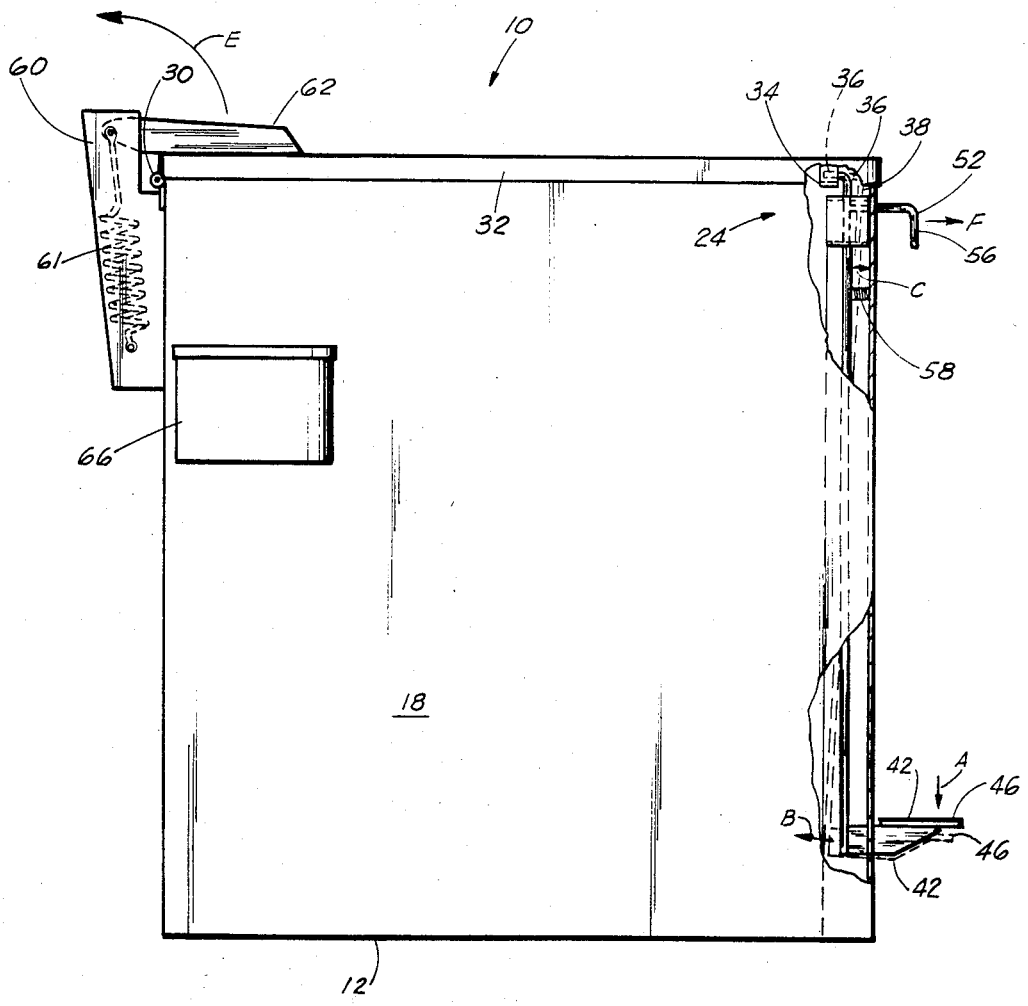
FIG. 2 is a side view illustrating the lifting assembly and release mechanism.

Means 26 for causing top 22 to automatically open upon disengagement of release pin 36 from closing latch 34 is provided on the exterior of rear wall 14 and top 22. Means 26 is generally comprised of lifting spring assembly 60 which houses a spring 61 and lifting arm 62. Lifting spring assembly 60 is rigidly attached to the exterior of rear wall 14 and houses spring 61 attached to the bottom portion thereof. Lifting arm 62 is rigidly connected to the top portion of top 22 adjacent its rear end and is pivotally attached to lifting spring assembly 60 and connected to spring 61 housed therein to cause normally urged arm 62 to its upward position as illustrated in FIG. 1, thus causing top 22 to open as indicated by ARROW E upon disengagement of release pin 36 from closing latch 34. This eliminates the necessity for manual opening of top 22 when an emergency arises and access to life preservers stored therein is necessary.

Means 28 for illumination of the interior of apparatus 10 and the contents therein are also provided on apparatus 10. Light 64 is positioned on the interior side of top 22 substantially near the center thereof so that light 64 is aimed toward the interior of apparatus 10. Light 64 is energized by batteries not shown housed in battery box 66. Battery box 66 is rigidly attached to side wall 18 of apparatus 10. Electrical power is supplied to light 64 through an electrical line provided in conduit 68 which is in electrical communication between the batteries housed in battery box 66 and light 64. A normally closed switch 70 is provided in the electrical line intermediate the power source and light 64 to prevent a constant drain on the battery while top 22 is in its closed position. As seen from the drawings, switch 70 is provided with spring loaded button 72 which is in its closed position as illustrated in FIG. 1. Button 72 when in its closed position, allows electrical energy from the power source to be provided to light 64, causing illumination of light 64 and the interior of apparatus 10. It is readily seen from the drawing that when top 22 is in its closed position, button 72 will be forced downward by pressure of top 22, thus opening switch 70 and ceasing illumination of light 64. Light 64 is thus energized only upon opening of top 22 for illumination of the interior of apparatus 10 only when necessary. Although batteries have been described as the source of electrical power, it should be understood that any suitable source of electrical power may be used for illumination of light 64.

In operation, in the event an emergency arises, a person in need of life preservers stored in apparatus 10 may cause apparatus 10 to be opened in one of two ways. First, the user may apply downward foot pressure on foot pedal 42 as indicated at ARROW A. This causes the lower portion of rod 38 to deflect toward the rear of apparatus 10 as indicated by ARROW B. This in turn causes the upper portion of rod 38 to deflect toward the front portion of apparatus 10 as indicated by ARROW C and also cause release pin 36 to move horizontally toward the front of apparatus 10 thus disengaging from closing latch 34 on top 22. The lifting spring assembly 60 and lifting arm 62 then cause top 22 to open to the position illustrated in FIG. 1 by spring pressure exerted on lifting arm 62. Upon opening of top 22, pressure is released on spring loaded button 72 in switch 70, thus providing electrical energy from a power source housed in box 66 to light 64. Light 64 illuminates the interior of apparatus 10 to provide easy retrieval of life preservers stored within apparatus 10. A second means of opening top 22 or releasing top 22 for opening is provided by handle 52. The user simply pulls handle 52 in the direction indicated by ARROW F to cause release pin 36 to disengage from closing latch 34. Top 22 will then automatically open as described above. The dual means of releasing top 22 for automatic opening is provided in the event that the user has received injury to either hands or feet which may be caused by the large variety of emergencies which may take place on an offshore drilling site. This provides an extra safety margin in allowing users access to life preservers stored in containers such as the present invention on offshore drilling sites.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a liminting sense.

What is claimed as invention is:

1. A storage container for life preservers, comprising:

a. a body portion having a bottom portion, a rear wall, at least two side walls and a front wall, said rear wall, front wall and side walls extending upwardly from said bottom portion, providing said body portion with an open top and defining a storage chamber interior of said walls;

b. a top portion hingedly connected along the upper edge of said rear wall for closing said opening and movable between a first opened position and a second closed position;

c. means connected to said rear wall and said top portion for normally urging said top portion to said first position, said means further comprising:

i. a lifting spring assembly rigidly attached to said rear wall; and ii. a lifting arm attached to said top portion and in engagement with said lifting spring assembly, said lifting arm normally urging said top portion to said first position in response to pressure from said lifting spring assembly;

d. means for latching said top portion in said second position, said means further comprising:

i. a latch member positioned adjacent said front wall and movable between a first latching position and a second releasing position;

ii. a closing latch positioned on said top portion and adapted to releasably receive said latch member and retain said top portion in said second position when said latch member is in said first position;

iii. a spring in engagement with said latch member and said front wall normally urging said latch member toward said first position;

e. means operable by hand and foot for disengaging said latching means and allowing said top portion to move to said opened first position, said means comprising:

i. a foot operable actuator attached to the lower portion of said latch member and extending exterior of said body portion, said actuator causing said latch member to move to said second position and disengage from said closing latch in response to pressure upon said actuator, allowing movement of said top portion from said second position to said first position; and ii. a hand operable actuator attached near the upper portion of said latch member and extending exterior of said body portion, said actuator causing said latch member to move to said second position in response to pressure upon said actuator in opposition to said spring.

f. light means activated when said top portion moves to said first position for illumination of said storage chamber.

2. The apparatus of claim 1, wherein said container is constructed of a lightweight metal.

3. The apparatus of claim 1, wherein said means for illumination of said storage chamber comprises:

a. a source of electrical power;

b. a lamp connected to said source of power and positioned on said top portion substantially facing said storage chamber; and c. switch means connected between said source of power and said lamp for illuminating said lamp when said top portion is in said first position and preventing illumination of said lamp when said top portion is in said second position.

4. A storage container for life preservers comprising:

a. a body portion having a bottom portion, a rear wall, at least two side walls and a front wall, said rear wall, front wall and side walls extending upwardly from said bottom portion, providing said body portion with an open top and defining a storage chamber interior of said walls;

b. a top portion hingedly connected along the upper edge of said rear wall for closing said opening and movable between a first open position and a second closed position;

c. a lifting spring assembly rigidly attached to said rear wall;

d. a lifting arm attached to said top portion and in engagement with said lifting spring assembly, said lifting arm normally urging said top portion to said first position in response to pressure from said lifting spring assembly;

e. means for releasably latching said top portion in said second position; and f. means for illumination of said storage chamber when said top portion is in said first position, comprising:

i. a source of electrical power;

ii. a lamp connected to said source of power and positioned on said top portion substantially facing said storage chamber; and iii. switch means connected between said source of power and said lamp for illuminating said lamp when said top portion is in said first position and preventing illumination of said lamp when said top portion is in said second position.

5. The apparatus of claim 4, wherein said means for releasably latching said top portion is operable by hand or foot actuation.

6. The apparatus of claim 4, wherein said means for releasably latching said top portion comprises:

a. a latch member positioned adjacent said front wall and movable between a first latching position and a second releasing position;

b. a closing latch positioned on said top portion and adapted to releasably receive said latch member and retain said top portion in said second position when said latch member is in said first position;

c. a spring in engagement with said latch member and said front wall normally urging said latch member toward said first position;

d. a foot operable actuator attached to the lower portion of said latch member and extending exterior of said body portion, said actuator causing said latch member to move to said second position and disengage from said closing latch in response to pressure upon said actuator, allowing movement of said top portion from said second position to said first position; and e. a hand operable actuator attached near the upper portion of said latch member and extending exterior of said body portion, said hand actuator causing said latch member to move to said second position in response to pressure upon said hand actuator in opposition to said spring.

7. A storage container for life preservers, comprising:

a. a body portion having a bottom portion, a rear wall, at least two side walls and a front wall, said rear wall, front wall and side walls extending upwardly from said bottom portion, providing said body portion with an open top and defining a storage chamber interior of said walls;

b. a top portion hingedly connected along the upper edge of said rear wall for closing said opening and movable between a first open position and a second closed position;

c. a lifting spring assembly rigidly attached to said rear wall;

d. a lifting arm attached to said top portion and in engagement with said lifting spring assembly, said lifting arm normally urging said top portion to said first position in response to pressure from said lifting spring assembly;

e. a latch member adjacent said front wall and movable between a first latching position and a second releasing position;

f. a closing latch positioned on said top portion and adapted to releasably receive said latch member and retain said top portion in said second position;

g. a spring in engagement with said latch member and said front wall and normally biasing said latch member toward said first position;

h. a first actuator attached to the lower portion of said latch member and extending exterior of said body portion, said first actuator causing said latch member to move to said second position in response to pressure upon said first actuator;

i. a second actuator attached near the upper portion of said latch member and extending exterior of said body portion, said second actuator causing said latch member to move to said second position in response to pressure upon said second actuator in opposition to said spring;

j. a source of electrical power;

k. a lamp connected to said source of power and positioned on said top portion substantially facing said storage chamber; and l. switch means connected between said source of power and said lamp for illuminating said lamp when said top portion is in said first position and preventing illumination of said lamp when said top portion is in said second position.

8. The apparatus of claim 7, wherein said apparatus is constructed of aluminum.

* * * * *